United States Patent [19]

Salomon

[11] 4,353,576

[45] Oct. 12, 1982

[54] SYSTEM FOR BINDING A BOOT TO A SKI

[75] Inventor: Georges P. J. Salomon, Annecy, France

[73] Assignee: Etablissements Francois Salomon & Fils, Annecy, France

[21] Appl. No.: 113,164

[22] Filed: Jan. 18, 1980

[30] Foreign Application Priority Data

Jan. 26, 1979 [FR] France ..... 79 02002

[51] Int. Cl.[3] ..... A63C 9/10

[52] U.S. Cl. ..... 280/615

[58] Field of Search ..... 280/607, 614, 615, 636, 280/7.13

[56] References Cited

U.S. PATENT DOCUMENTS 3,775,866 12/1973 Marker ..... 280/615 X 3,979,131 9/1976 Ginther ..... 280/615

FOREIGN PATENT DOCUMENTS 2659586 7/1978 Fed. Rep. of Germany ..... 280/607

*Primary Examiner*—Joseph F. Peters, Jr.

*Assistant Examiner*—Michael Mar

*Attorney, Agent, or Firm*—Pollock, Vande Sande & Priddy

[57] ABSTRACT

A system for binding a boot to a ski intended for the practice of cross-country skiing. A connection between boot and ski is provided at the front of the boot, while the heel of the boot is free to lift with respect to the top surface of the ski. Structure for laterally holding the boot on the ski is provided between the sole of the boot and the top surface of the ski, and comprises two pieces, one of which is fixedly arranged on the part of the sole corresponding to the plantar support zone of the metatarsal zone, while the other piece is fixed to the ski in the zone where the first piece abuts.

14 Claims, 21 Drawing Figures

FIG. 3
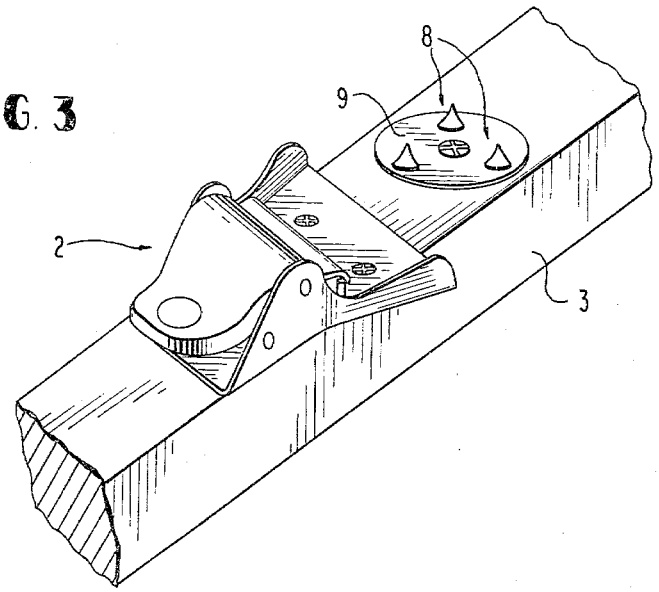
FIG. 4
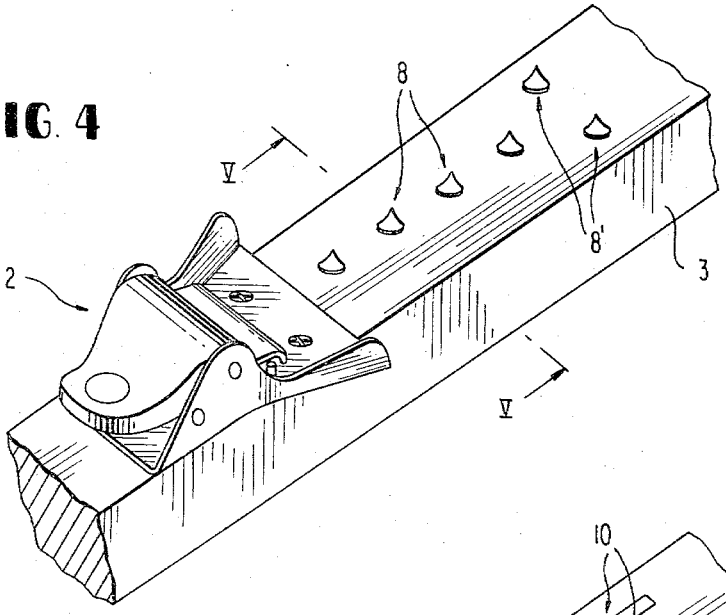
FIG. 5
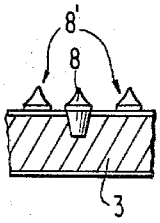
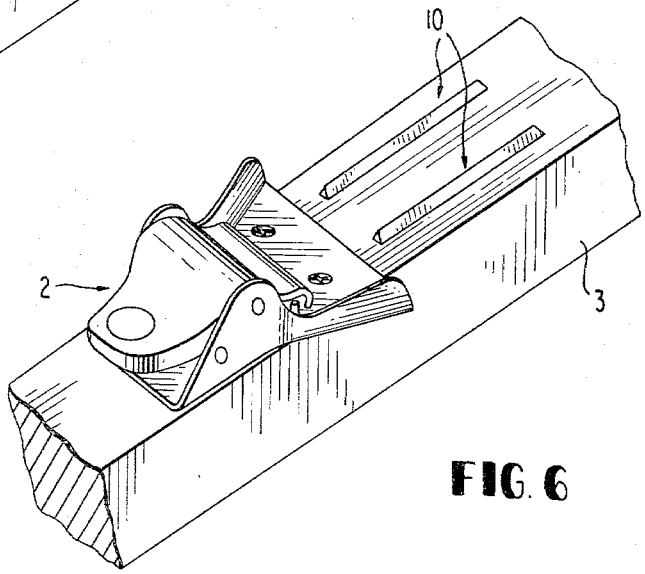
FIG. 6

FIG. 13
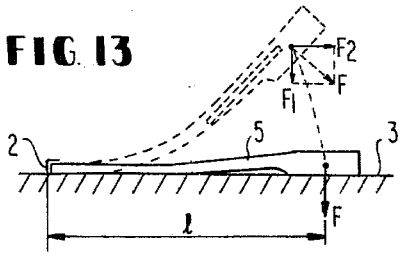
FIG. 14
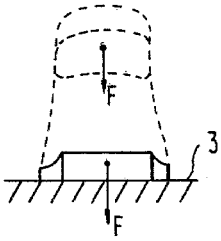
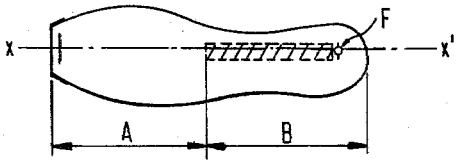
FIG. 15
FIG. 16
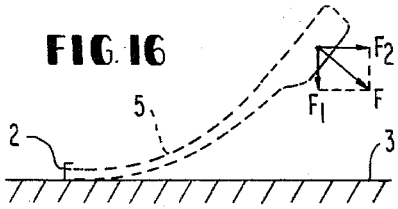
FIG. 17
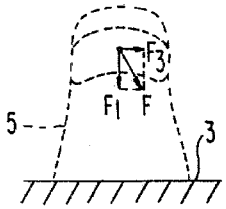
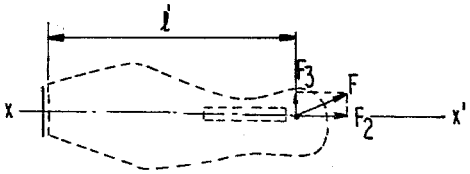
FIG. 18
FIG. 19
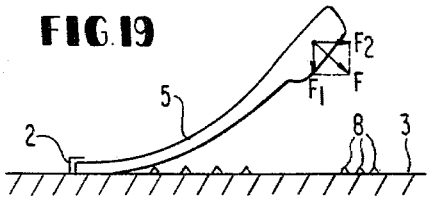
FIG. 20
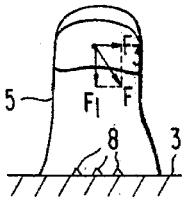
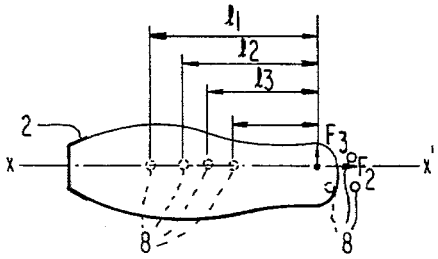
FIG. 21

SYSTEM FOR BINDING A BOOT TO A SKI

BACKGROUND OF THE INVENTION

The present invention relates to a system for binding a boot to a ski, intended for the practice of cross-country skiing.

Ski boots presently worn for practising cross-country skiing are being more and more often designed with means for laterally guiding and retaining the heel so as to allow movement of the foot which remains as much as possible in the longitudinal axis of the ski, and thus enhance control of the ski itself.

Various types of construction for achieving such retention of the heel are known. For example, in one type of cross-country ski boot the sole cooperates with the ski via a cylindrical centering stud engaging in a corresponding hole in said sole. In this construction, the difficulty in exactly centering the foot on the ski is immediately apparent, as the hole in the sole must be engaged with the stud, said hole and said stud each being located in the zone of the heel. The difficulty of centering this type of boot on the ski is further increased in that snow may, at least partially, block up the hole in the sole, thus rendering this arrangement completely ineffectual.

similar difficulties in centering are encountered in other prior art constructions, where the foot is guided only when the heel of the boot comes to rest on the ski.

Thus, certain types of construction employ hard tips, disposed in triangles and projecting from the top surface of the ski, to penetrate in a zone of softer material, located beneath the heel, opposite said tips, when the foot reaches the final phase of its downward movement and comes to rest on the ski.

According to another embodiment, a flexible heel piece provided on each of its sides with a metal ridge cooperating with the heel of the boot to assure control thereof, is disposed on the ski.

In other known arrangements, notched sectors project from the top surface of the ski where they are fixed, to cooperate with the heel of the boot.

All of these prior art structures share the drawback that the centering of the boot on the ski is effected only in the final phase of the movement of the foot when said latter comes into contact with the ski. In fact, these means for controlling and guiding the boot assure centuring of said boot only in the last millimeters of the movement of the foot, and do not really prevent the off-centered and offset movements of the foot with respect to the axis of the ski which may occur during skiing on hilly terrain.

In such situations, the skier must then correct the positions of his foot during the striding motion, and this correction wastes time and even causes loss of balance, both of which is prejudicial to performances, particularly in competition.

SUMMARY OF THE INVENTION

The object of the invention is to remedy the drawbacks of the different prior art structures by producing a ski boot for the practice of cross-country skiing wherein the centering of the sole is advantageously effected during all the phases of movement of the foot with respect to the longitudinal axis of the ski and to its top surface. According to another advantageous feature of the invention, this object is attained by the use of means of reduced dimensions and weight, whose functioning remains reliable in all conditions of use. To this end, a system for binding a boot to a ski is produced, comprising means for connecting boot and ski, located at the front of the boot, and allowing the heel of said boot to lift from the top surface of the ski, and means for laterally holding the boot on the ski located between said boot and the ski at least in the metatarsal zone part of said lateral retention means being located beneath and being fast with the boot, while the other part is located on the top surface of the ski, one of these parts comprising at least one rigid, projecting piece pressing into the other part comprising a retention piece made of soft material.

The binding system according to the invention thus offers the advantage that it assures retention of the foot in position from the beginning of the phases of movement of the foot during skiing. In fact, tests have shown that it is advantageous, with modern cross country ski boots, to assure this lateral holding of the boot on the ski during the phase of passive extension of the foot in preparation for the following step. This necessity is all the more imperative as present day competition boots, for example, are generally fixed to the ski by an extension of the sole at the front of said boot. This extension of the sole, generally composed of a supple material, serving for connection with the ski, cooperates with the binding only over a reduced portion with respect to the length of the boot itself, and can consequently not assure any real guidance of the boot for in turn suitable guiding the ski.

The system according to the invention overcomes this drawback in that it makes possible, in this important phase of movement of the foot, lateral retention right from the beginning of the return movement of the foot onto the ski when the sole of the boot, contacting the ski, permits pressing and penetration of the rigid part, into the soft part both advantageously located in the zone extending at least from the toes to the metatarsal supports of the sole.

A first embodiment of the invention comprises a boot for cross-country skiing the sole, of which made of supple but abrasion-resistant material, advantageously comprises, in the metatarsal zone, at least one recess provided with an insert made of relatively soft material, located under the metatarsal zone, where the zone of flexion of the sole is located. The boot thus produced cooperates with a projecting part of pointed form, located on the surface of the ski so that, when the boot is connected to the ski by its binding, said soft material, disposed in the recess, cooperates with said rigid projecting part. This cooperation is effected not only completely when the sole of the boot rests completely on the ski, the foot being flat, but also partly when, during walking movement, the foot moves forward and the heel has totally lifted from the top surface of the ski. Thus, when the foot returns to its flat position on the ski during the final phase of its movement, the cooperating parts are again totally pressed together and thus perfect the lateral retention of the boot on the ski.

However, it is not absolutely necessary to limit this first embodiment to a hard and supple sole provided with recesses filled with softer materials. It is possible, without departing from the scope of the invention, for the entire sole of the boot to be composed of soft material cooperating directly with the or each projecting part located on the ski.

According to another embodiment of the invention, a the sole of the boot advantageously comprises, at least in the front zone from the toes to the metatarsal zone, at least one projecting part of relatively sharp form cooperating, by penetration, with a part of softer material located on the ski in the zone corresponding to that of the projecting part of the sole.

It is also possible, without departing from the scope of the invention, to provide the sole with a series of projecting parts arranged according to the desired effects, beneath the entire surface of said sole, in variable geometrical arrangements. In this case, the sole made of supple, but abrasion-resistant material, is sufficiently flexible and firm for the projecting parts to resist wear and crushing when the boot is used simply for walking.

In a variant embodiment of the sole with projecting parts, the latter are arranged so that, in walking position, they cannot contact the ground. To this end, they are advantageously disposed in a recess in the sole whose depth is greater than the height of said projecting parts.

For each of the possible embodiments, it will be obvious that the projecting parts need not be conical studs, but may, for example, comprise sharp ridges or varied geometrical lines. Finally, the parts made of soft material are preferably made of compact elastic materials which are not spongy, so that they do not absorb water or snow, which would be prejudicial to the penetration of the projecting parts in case of freezing, and which would reduce the effects of absorption of the ski boot.

BRIEF DESCRIPTION OF THE DRAWINGS

The invention will be more clearly understood on reading the following description with reference to the accompanying drawings in which:

FIGS. 3 and 4 are views in perspective of different arrangements of the projecting parts located on the top surface of the ski for cooperation with the parts made of soft materials, constituting the means for laterally holding the system according to the invention.

FIG. 5 is a view in transverse section along V—V of FIG. 4.

FIG. 6 is a view in perspective of another variant embodiment of the projecting parts.

FIGS. 13 to 21 are diagrams illustrating the deformation of a cross-country ski boot and the advantages offered by the invention.

DESCRIPTION OF THE PREFERRED EMBODIMENTS

Figure 1:
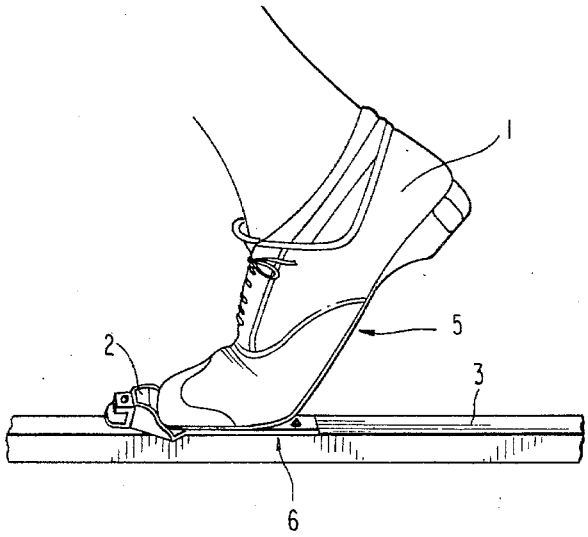
FIGS. 1 and 2 show a system according to the invention, respectively in perspective and in vertical and longitudinal section, comprising the means for laterally retaining the cross country ski boot in the course of the phase of passive extension during the movement of the foot on the ski.
Figure 2:
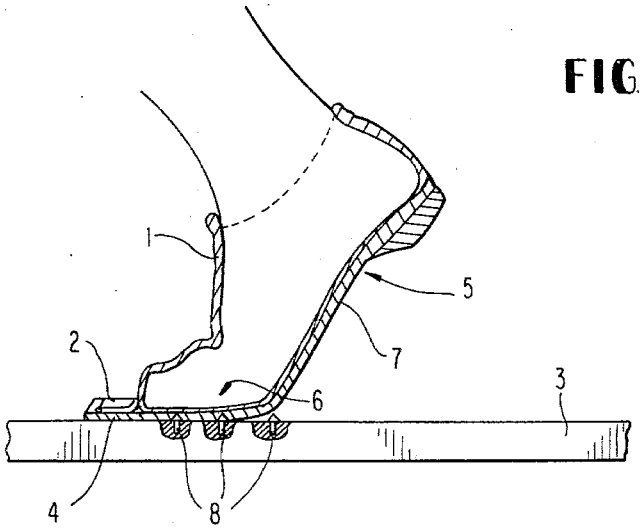

Referring now to the drawings, FIGS. 1 and 2 show a system for binding a cross country ski boot 1 to a ski 3 by means of a binding 2 of known type cooperating, for example with an extension 4 located at the front of the sole 5, in which system retention means 6 ensure lateral retention of the boot on the ski. In this system the sole 5 of said boot 1 advantageously comprises, under the metatarsal zone of the skier's foot, a part of the lateral retention means which is composed of a portion of sole 7 made of soft material cooperating with conical studs 8 projecting from the top surface of the ski and constituting another part of the lateral retention means 6. The conical studs 8 are disposed to the rear of the binding 2 in the front zone of the foot from the toes to the metatarsal zone, for example, immediately adjacent the front extension 4 of the sole 5 used for the connection with the ski. This arrangement thus promotes the cooperation of parts 7 and 8 comprising retention means 6 during all the phases of movement of the foot from its total plantar support to its partial support at toe level.

In particular, the cooperation of the studs 8 with the portion of sole 7 made of soft material is assured by the penetration of said studs 8 composed of a hard and rigid material into the soft material of the portion 7 of the sole under the force of the weight of the skier. The penetration or deformation of said soft material 7 then assures a temporary additional connection of the boot with the ski.

As may be seen in FIGS. 3 and 4, the studs 8 may be added and fixed to the ski in various geometrical arrangements. In any case, a first of these studs is located in the zone immediately adjacent the binding 2 so that a connection additional to that of the binding 2 is always assured between the boot and the ski, and more precisely in the case of the boot in position of passive extension of the foot when the zone of contact of the sole 5 with the top surface of the ski 3 is reduced to a minimum. In the embodiment of FIG. 3, the studs 8 are distributed on the circumference of a circular plate 9 assembled on the ski. In the embodiment of FIGS. 4 and 5, these studs 8 are successively aligned along the longitudinal axis of the ski, with a row of them, 8', being arranged perpendicularly to this longitudinal axis, to the rear of the preceding ones, to further perfect the lateral retention in the zone of metatarsal flexion of the boot.

However, the projecting part of the holding means 6 is not limited to the use of conical studs. It is also possible to use, without departing from the scope of the invention, ribs 10 with relatively sharp edges (FIG. 6) cooperating in the same manner with the part of the sole 7 made of soft material where said edges will penetrate to assure the additional connection between boot and ski. As in the case of the studs, the ribs 10 penetrating and assuring a temporary additional anchoring, according to the phases of movement of the foot, will progressively and virtually constantly increase the dimensions of connection at the level of the binding of the boot on the ski.

It will be obvious that the ribs 10 are not solely intended to be disposed on the ski parallel to the longitudinal axis thereof, but that a transverse arrangement or one inclined by any angle with respect to this longitudinal axis is possible without departing from the scope of the invention.

Figure 7:
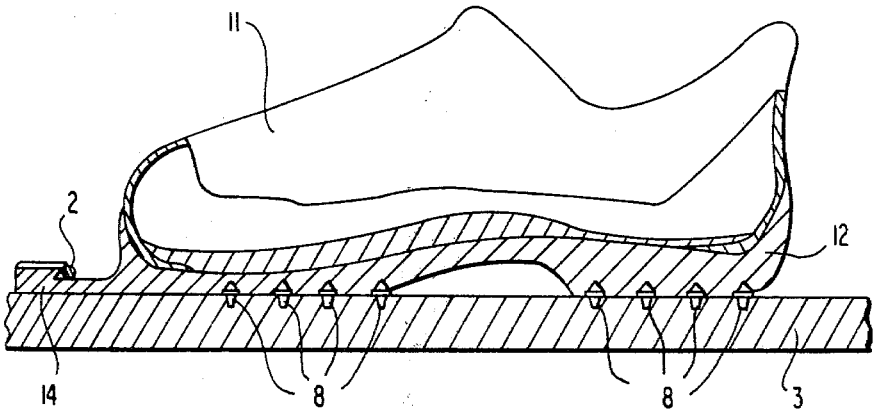
FIG. 7 is a view in vertical and longitudinal section of a variant embodiment of the system according to the invention, wherein the part made of soft material cooperating with the projecting parts located on the ski is constituted by the whole sole.

FIG. 7 shows a boot 11 in vertical and longitudinal section, of which the monobloc sole 12 molded with the upper is exclusively made of a supple and relatively soft material, performing the role of partly absorbing the projecting parts 8, distributed under the whole length of the support surface of the sole on the ski, in order to perfect lateral retention of the boot from its front end to its heel.

Figure 8:
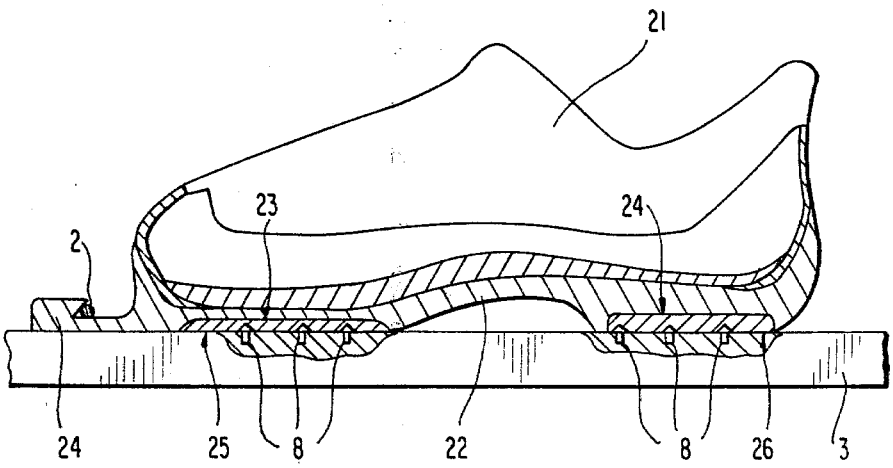
FIG. 8 is a view in vertical and longitudinal section of another variant embodiment, wherein the part made of soft material is partially and locally inserted into recesses made in a supple but abrasion-resistant sole.

FIG. 8 shows a boot 21 of which the sole 22, made of supple but abrasion-resistant material (e.g. of the type known under the trade name "Hytrel"), comprises recesses 23 and 24 respectively located in the metatarsal zone of the boot and in the heel zone and filled with respective inserts 25 and 26 made of soft material, e.g., of the elastomer, rubber type, in each of which embedded a series of studs 8 projecting from the top surface of the ski.

FIGS. 9 to 12 show, in three different embodiments, another possible construction of the system according to the invention. This solution uses the arrangement opposite to of that previously described, in that the lateral retention means between ski and boot comprise a projecting part beneath the sole of the boot and a part for absorbing said projecting part on the ski itself.

Figure 9:
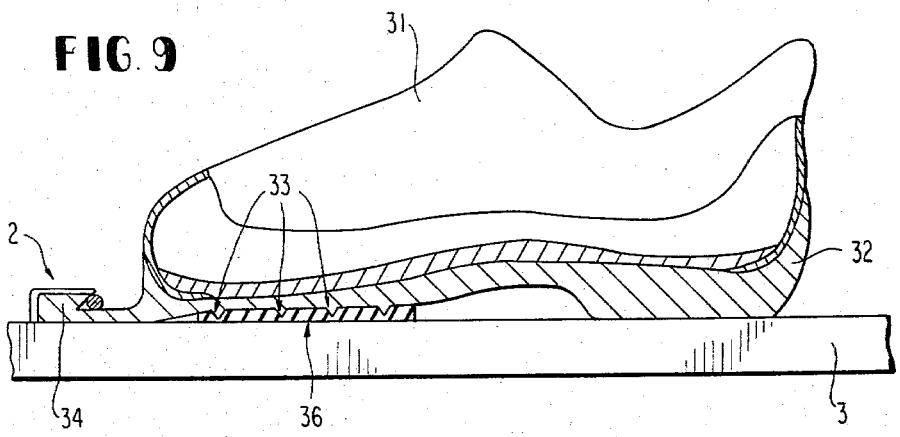
FIGS. 9 to 11 are views in vertical and longitudinal section of three variant embodiments of the system according to the invention, wherein the lateral holding means are composed of projecting parts, located beneath the sole of the boot itself, and of parts made of soft material located on the ski.
Figure 10:
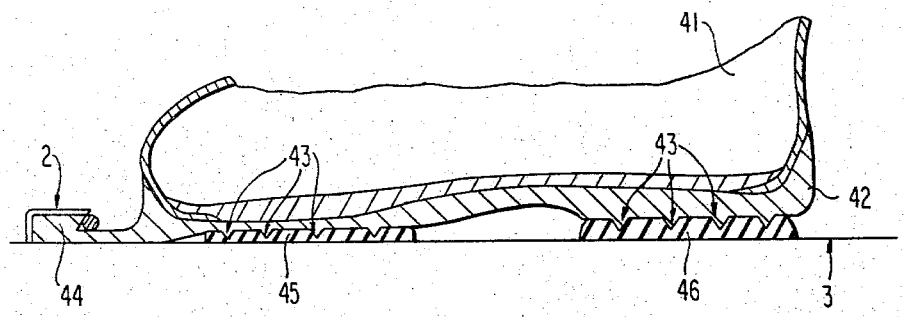

FIG. 9 shows a cross-country ski boot 31 which comprises a sole 32 made of supple but abrasion-resistant and relatively hard material extending forwardly by a tongue 34 for connection with a binding 2. In the metatarsal zone adjacent said tongue 34, the sole 32 is provided with a series of studs 33 of pointed form made of the same material as the sole, for example. The said studs are arranged in various geometrical dispositions and penetrate or deform a plate 36 made of soft material adhered to the ski in the metatarsal zone. The studs 33 directed towards the surface of the ski penetrate into the plate 36 and assure additional cooperation to that of the binding 2 with the boot. These studs 33 are located, according to the principle already set forth, in immediately proximity to the zone of flexion of the extension 34 in the binding 2, so that their anchoring in the plate 36 occurs even in the extreme position of passive extension of the foot. In FIG. 10, the zone of implantation of the studs 43 has been extended to the zone of support of the heel, so that the lateral retention of the boot is also extended to the whole support surface of the sole of said boot.

Thus, the boot 41 comprises a sole 42 provided with a front tongue 44 for connection with the binding 2, and with studs 43 disposed both in the metatarsal zone, where they cooperate with a soft plate 45, and in the zone of the heel, where they cooperate with a soft plate 46, both simultaneously assuring a greater lateral retention, since it is assured under the entire surface of the sole, and performing the function of shock absorption when the heel returns onto the ski.

Figure 11:
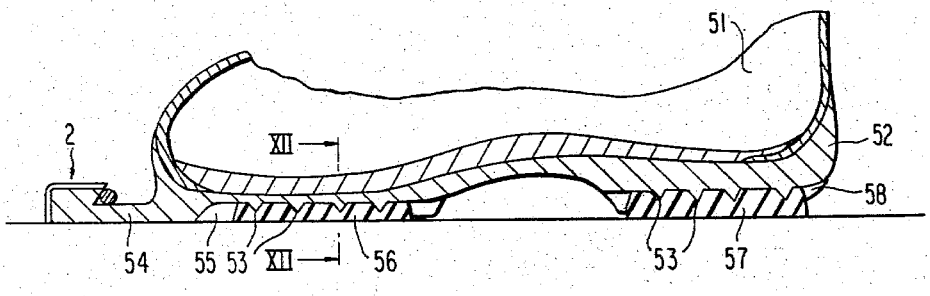
Figure 12:
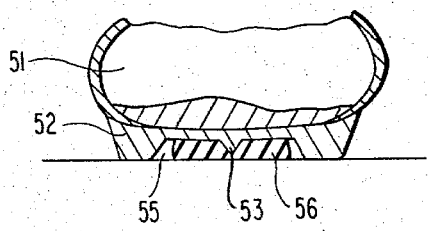
FIG. 12 is a view in transverse section along XII—XII of FIG. 11.

FIGS. 11 and 12 show in section, the third embodiment of the principle of construction where the studs are located on the sole of the boot. In fact, the boot 51 comprises a sole 52 made of supple, but abrasion-resistant and relatively hard material extended by a front tongue 54 for connection with the binding 2. The sole 52 comprises, in its front part and to the rear of the extension 54, a recess 55 whose depth is greater than the height of the studs 53 which are located in the bottom of said recess. This arrangement prevents the premature wear and tear of the studs 53 and may be limited to the metatarsal part only, contrary to the illustration of FIG. 11 where it has been extended to the zone of the heel which also comprises a recess 58 in the bottom of which project studs 53. Plates 56 and 57 of soft material are then respectively disposed beneath the metatarsal and heel zones, i.e., under the recesses 55 and 58. Their thickness is slightly greater than the depth of the recesses 55 and 58 and of smaller dimensions than those of these recesses so as to permit accomodation of the volume of the soft material crushed under the weight of the skier. In this case, too, the role of the plates 56 and 57 is not limited to that of receiving the projecting parts, but is extended to a role of shock absorption when the foot returns onto the ski.

With more particular reference to FIGS. 13 to 21, the differences of the invention over the prior art, as well as the novel results of the invention, will now be explained.

The structure of the soles of cross-country ski boots cooperating with studs located in the zone of the heel is generally composed of a zone A (FIG. 15) which may be deformed and a zone B, fairly rigid, for assuring good retention of the foot. This virtually undeformable zone B covers approximately the rear half of the sole 5 of the boot while the deformable zone A extends more particularly over the front half (metatarsal zone) of said sole, precisely to allow the movement of the foot when practising cross-country skiing. Furthermore, the binding of the boot on the ski 3 being located at the tip of the sole, the latter is assimilable to a built-in beam (all proportions being maintained) on which is exerted the effort F in the longitudinal plane xx' applied by the skier's leg (cf. FIGS. 13, 14, 15), this force F being broken down into two forces located in the longitudinal vertical plane xx', namely a vertical force F1 directed downwardly and a horizontal force F2 directed rearwardly.

It then appears that the distance 1 e existing between the connection (binding 2) and the point of application of the force F covers the whole length of the sole 5, consequently allowing considerable bending moments. These are not a hindrance when the movement of the foot is made under normal conditions, but they become so when the movement of the foot is no longer made along the axis of the ski (skater's step, herring bone, bends, descents with heel raised, etc). In these cases, the force F is inclined with respect to the longitudinal vertical plane xx', the angle of inclination of the force F being permitted by the deformation of the flexible sole 5 in the metatarsal zone A. In this case, the force F may be broken down into three forces F1, F2 and F3 as indicated in FIGS. 16, 17 and 18, force F3 extending transversely.

The force F1 has the same incidence as under normal conditions on the movement of the sole which it returns on the ski, while the force F3, directed (in the case illustrated) perpendicular to the axis of the sole 5, then exerts a moment of deformation proportional to the distance 1' e' from the point of binding 2 to the point of application of force F3.

The main purpose of the invention is to remedy and eliminate the moment of deformation whose influence is particularly prejudicial for guiding the ski in the movements mentioned hereinabove, in that the arrangement of the anchoring studs 8 in the metatarsal zone A supplements the lateral retention provided by connection 2 for binding the boot on the ski, this being done progressively as the sole 5 returns flat onto the ski 3, so that the moment of deformation decreases correlatively with the reduction of the distance of the lever arm ($F3 \times l_1 > F_3 \times l_2 > F_3 \times l_3$) (FIGS. 19, 20, 21).

The metatarsal zone A then being perfectly anchored due to studs 8 or other lateral retention means, the additional lateral retention extends to the deformable zone of the sole which assures the rigid relay in the return of the sole flat onto the ski, the heel of the sole requiring only a few millimeters of further movement to engage with, e.g., the studs for anchoring the heel which are known per se and which may assure additional lateral retention.

What I claim is:

1. A system for binding a boot to a ski intended for cross-country skiing, comprising (a) means for connecting said boot and said ski located at the front of said boot and allowing the heel of said boot to lift with respect to the top surface of said ski; and (b) means for laterally retaining said boot on said ski during the full course of its descent from a position in which its metatarsal and heel portions are raised from the surface of said ski, to a position in which said portions rest on said ski, said means being located between the sole of said boot and the top surface of said ski under the metatarsal zone of the foot of the user of said ski, and comprising two members, one of said members comprising at least one rigid piece provided with at least one projection, the other of said members comprising a piece made of soft, elastic material for said one of said members;

(c) one of the said members being fixedly arranged on the part of said sole corresponding to the plantar support zone of the metatarsal zone, and the other of said members being affixed to said ski in the zone where said first member abuts.

2. A binding system as claimed in claim 1, wherein said rigid piece is affixed to the top surface of said ski, and said piece made of soft material is fixedly arranged on said sole of said boot.

3. A binding system as claimed in claim 1, wherein said rigid piece is fixedly arranged on said sole of said boot, and said piece made of soft material is affixed to said top surface of said ski.

4. A binding system as claimed in one of claims 1 to 3, wherein said rigid piece comprises a plurality of projections composed of conical studs.

5. A binding system as claimed in claim 4, wherein said conical studs are disposed parallel to the longitudinal axis of said ski.

6. A binding system as claimed in claim 4, wherein said conical studs are disposed transversely with respect to said longitudinal axis of the ski.

7. A binding system as claimed in any one of claims 1 to 3, wherein said projections are strips having at least one sharp edge made of hard, rigid material, attached to the top surface of said ski.

8. A binding system as claimed in claim 7, wherein said strips are disposed on the ski parallel to its longitudinal axis.

9. A binding system as claimed in claim 7, wherein said strips are disposed on the ski transversely to its longitudinal axis.

10. A binding system as claimed in any one of claims 1 to 3, wherein said piece made of soft, elastic material comprises a plate of predetermined thickness partially forming at least said sole of said boot.

11. A binding system as claimed in claim 3, wherein said rigid piece fixedly arranged on said sole is integral with said sole and comprises a plurality of studs of conical shape which are directed towards the top surface of said ski.

12. A binding system as claimed in claim 3, wherein said rigid piece comprises at least one rib having a sharp edge directed towards the top surface of said ski.

13. A binding system as claimed in claim 11, wherein said studs are arranged in a recess in said sole whose depth is greater than the height of said studs cooperating with said piece made of soft and elastic material, located on the ski, the thickness of which is substantially greater than the height of said studs.

14. A binding system as claimed in claim 12, wherein said at least one rib is arranged in a recess in said sole whose depth is greater than the height of said at least one rib cooperating with said piece made of soft and elastic material, located on the ski, the thickness of which is substantially greater than the height of said at least one rib.

* * * * *